US007488217B2

(12) United States Patent
Cheng et al.

(10) Patent No.: US 7,488,217 B2
(45) Date of Patent: Feb. 10, 2009

(54) ELECTRIC POWER CONNECTOR

(75) Inventors: I-Hung Cheng, Jhonghe (TW); Yu-Ki Chang, Jhonghe (TW)

(73) Assignee: Alltop Technology Co., Ltd, Taiwan (CN)

( * ) Notice: Subject to any disclaimer, the term of this patent is extended or adjusted under 35 U.S.C. 154(b) by 0 days.

(21) Appl. No.: 11/808,029

(22) Filed: Jun. 6, 2007

(65) Prior Publication Data

US 2008/0305691 A1 Dec. 11, 2008

(51) Int. Cl.
*H01R 24/04* (2006.01)

(52) U.S. Cl. ..... 439/668

(58) Field of Classification Search ..... 439/660, 439/188, 259, 635, 189, 668
See application file for complete search history.

(56) References Cited

U.S. PATENT DOCUMENTS 5,080,613 A * 1/1992 Orui et al. ..... 439/660
5,562,506 A * 10/1996 Wright ..... 439/675
5,913,694 A * 6/1999 Wright ..... 439/394
6,319,075 B1 * 11/2001 Clark et al. ..... 439/825
6,394,818 B1 * 5/2002 Smalley, Jr. ..... 439/79
7,309,242 B2 * 12/2007 Clark et al. ..... 439/79

* cited by examiner

*Primary Examiner*—Jean F Duverne
(74) *Attorney, Agent, or Firm*—Sughrue Mion, PLLC

(57) ABSTRACT

In an electric power connector comprised of a plug module and a socket module, a male metal terminals of the plug module and a female metal terminals of the socket module are respectively made out of a respective solid metal plate member through a continuous stamping process, and each male metal terminal has a base and two contact prongs bilaterally extended from one side of the base at different elevations, therefore the electric power connector eliminates electron ionization or thermal stress in the metal terminals, ensuring high stability and reliability of metal terminals in power transmission. Further, the two contact prongs of each male metal terminal are bilaterally extended from one side of the base thereof at different elevations so that when one contact prongs is deformed or curved accidentally by an external force, the other contact prong is still kept in positive contact with the associating contact prong of the matching female metal terminal to ensure the stability and reliability of the electrical connection between the male metal terminals and the female metal terminals.

8 Claims, 6 Drawing Sheets

ELECTRIC POWER CONNECTOR

BACKGROUND OF THE INVENTION

1. Field of the Invention

The present invention relates to electric connectors and more particularly, to an electric power connector in which each male metal terminal comprises a base and two contact prongs bilaterally extended from one side of the base at different elevations, and each female metal terminal comprises a base and two contact prongs forwardly extending from an extension at the base at different elevations and different angles for the contact of the contact prongs of the associating male metal terminal to ensure high stability and reliability in power transmission.

2. Description of the Related Art

When designing an electronic circuit, the circuit designer generally will concern two basic parts, i.e., the part of logic (or signal) and the part of power. Because of the current flowing through a logic circuit is low, the circuit designer needs not to consider the effect of status (for example, temperature) on electrical characteristics (for example, circuit component impedance) when designing a logic circuit. However, the flowing of a high current in a power circuit may cause a significant electric change of the electrical characteristics. Therefore, when designing an electric power connector, the dissipation of heat (due to joule effect) must be taken into account to minimize change of electrical characteristics subject to change of electric current. Further, the contact terminals of an electric power plug generally have the shape of a flat blade or round rod. This is the so-called singular-mass design. In a singular-mass contact terminal configuration, the female metal contact terminal comprises an inwardly projecting pair of suspension arms, and the matching contact blade or prong is set in between the two suspension arms of the female metal contact terminal. This design cannot minimize the size without affecting the heat dissipation efficiency. Further, this design simply allows for adjustment of the geometrical shape of the contact to provide a limited resilience that changes the normal contact force.

Therefore, an improved structure of electric power connector capable changing the normal contact force is developed. According to this design, as shown in FIG. 6, the metal terminal (plug contact) A comprises a base unit having two parallel sidewalls A1, and a front contact unit A2. The front contact unit A2 includes an upper part A21 and a lower part A22. The upper part A21 and the lower part A22 each have a pair of suspension arms. Each suspension arm comprises an inwardly curved proximity portion A211, a remote portion A213, and an arched contact portion A212 connected between the proximity portion A211 and the remote portion A213. The remote portion A213 curves slightly outwards. When the suspension arms are inserted with the front contact unit A2 into a metal contact terminal in an electric socket (not shown) and curved by the contact pressure, the remote portions A213 of each pair of suspension arms forced toward each other to protect against overstress. This double-mass metal terminal design provides a relative greater heat dissipation area when compared to the aforesaid singular-mass metal terminal design. When the plug contact is kept in contact with the matching socket contact, a flow passage is provided around the suspension arms for ventilation of air to dissipate heat. However, this design of metal terminal still has drawbacks. After long and repeated uses, the suspension arms of the upper part A21 and the lower part A22 of the front contact unit A2 may be curved due to elastic fatigue, resulting in contact instability. Further, when one suspension arm is curved or twisted accidentally by an external force, the other suspension arm of the same pair cannot be inserted into positive contact with the socket contact, lowering the electric connection stability and reliability between the plug contact and the socket contact, or resulting in a contact failure.

SUMMARY OF THE INVENTION

The present invention has been accomplished under the circumstances in view. According to one aspect of the present invention, the electric power connector is comprised of a plug module and a socket module. The plug module comprises an electrically insulative housing and a plurality of male metal terminals mounted in the electrically insulative housing. The socket module comprises an electrically insulative housing and a plurality of female metal terminals mounted in the electrically insulative housing. The male metal terminals and the female metal terminals are respectively made out of a respective solid metal plate member through a continuous stamping process, and each male metal terminal has a base and two contact prongs bilaterally extended from one side of the base at different elevations, therefore the electric power connector eliminates electron ionization or thermal stress in the metal terminals, ensuring high stability and reliability of the metal terminals in power transmission.

According to another aspect of the present invention, the two contact prongs of each male metal terminal are bilaterally extended from one side of the base thereof at different elevations. When one of the two contact prongs is deformed or curved accidentally by an external force, the other contact prong is still kept in positive contact with the associating contact prong of the matching female metal terminal, ensuring the stability and reliability of the electrical connection between the male metal terminals and the female metal terminals.

According to still another aspect of the present invention, the contact prongs of the male metal terminals impart a pressure to the contact prongs of the female metal terminals, and the resilient material property of the contact prongs of the female metal terminals produces a reactive force against the contact prongs of the male metal terminals, and therefore the smoothly curved contact surface portions of the female metal terminals are maintained in positive contact with the inner bearing surface portion of the contact prong respectively, ensuring excellent electrical connection.

According to still another aspect of the present invention, the male metal terminal or the female metal terminal has the respective contact prongs respectively extending from one side of the respective base. When compared with the conventional suspension arm type contact terminal design, the metal terminal design of the present invention saves much the consumption of material, thereby relatively lowering the cost.

DETAILED DESCRIPTION OF THE PREFERRED EMBODIMENT

Figure 1:
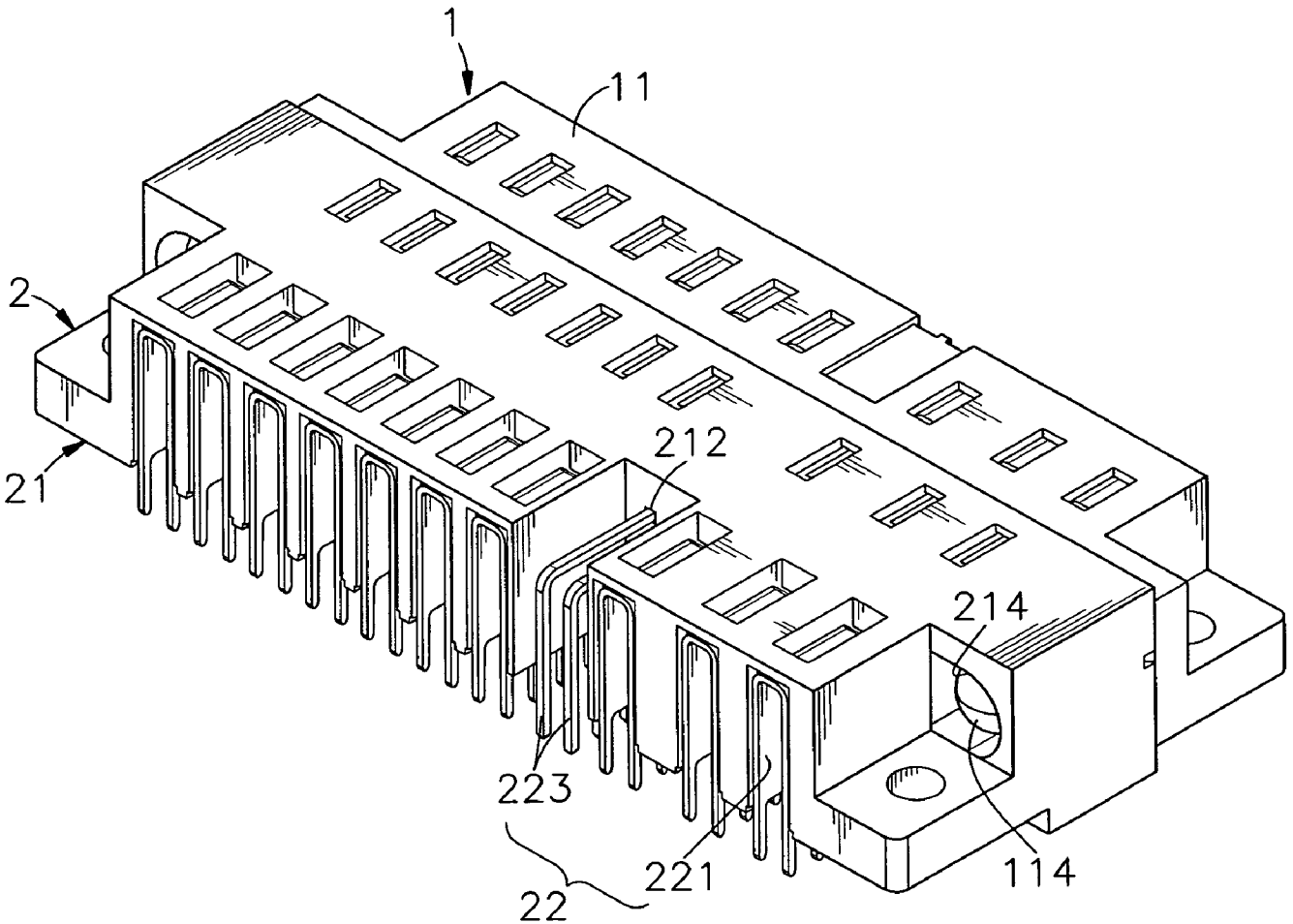
FIG. 1 is an elevational view of an electric power connector according to the present invention.
Figure 2:
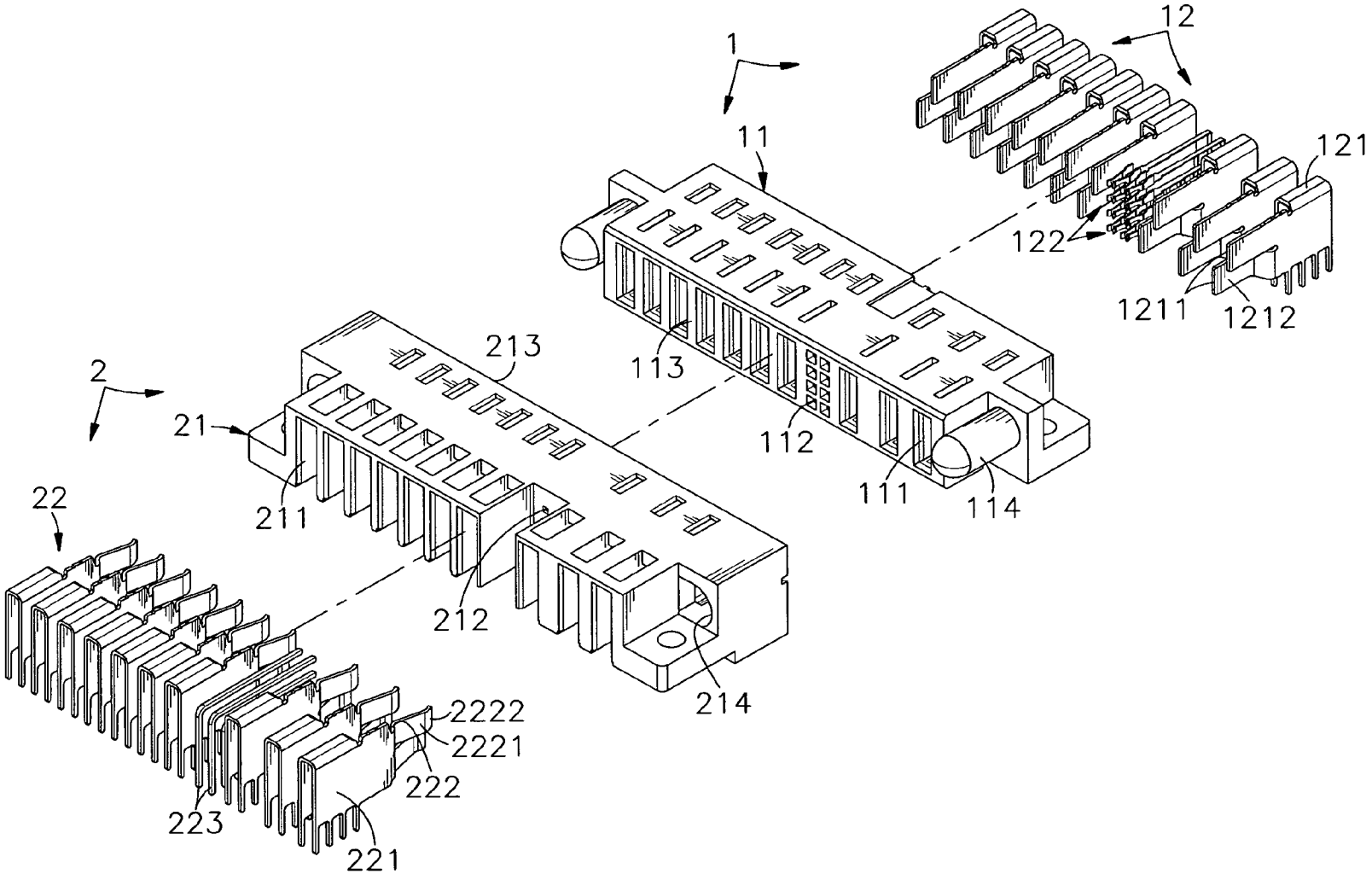
FIG. 2 is an exploded view of the electric power connector according to the present invention.
Figure 3:
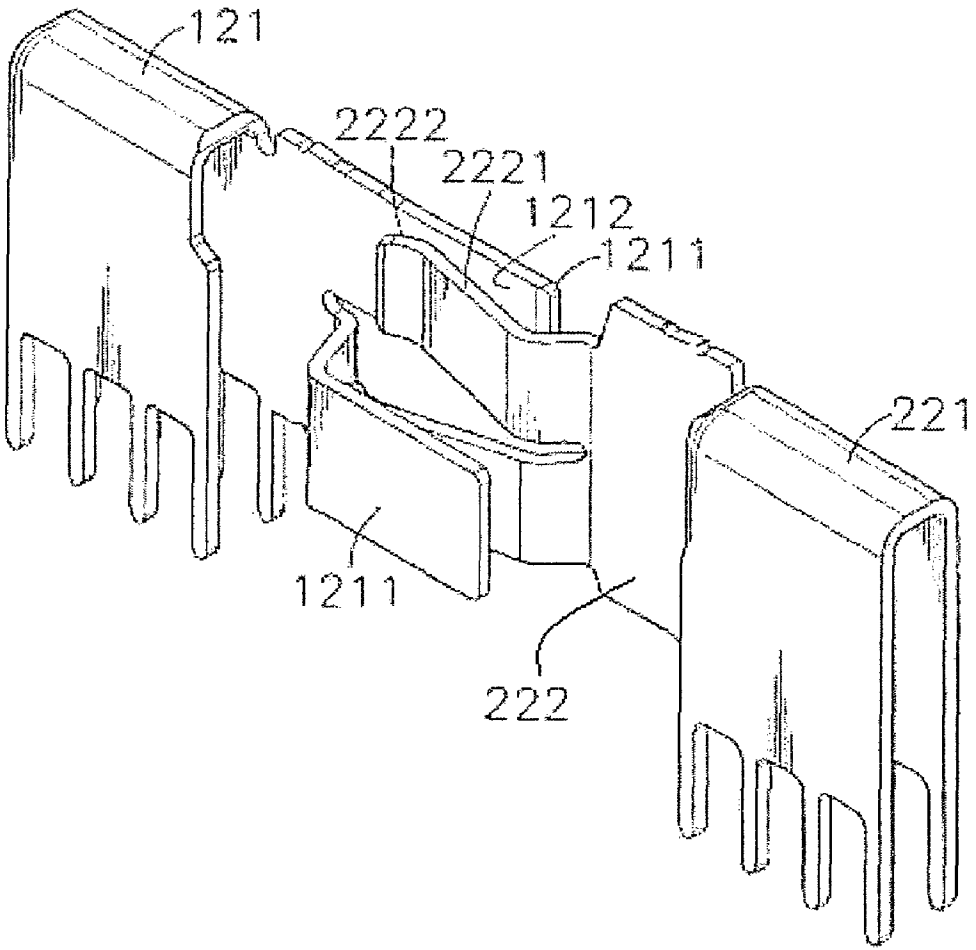
FIG. 3 is an elevational view showing one male metal terminal disposed in contact with the associating female metal terminal according to the present invention.

Referring to FIGS. 1, 2 and 3, an electric power connector is shown comprised of a plug module 1 and a socket module 2. The plug module 1 and the socket module 2 are abutted against each other and electrically connected together.

The plug module 1 comprises an electrically insulative housing 11, and a set of male metal terminals 12 mounted in the electrically insulative housing 11. The electrically insulative housing 11 has a plurality of terminal slots 111. The male metal terminals 12 are respectively inserted into the terminal slots 111 and positively positioned therein. Each male metal terminal 12 comprises a base 121, and two contact prongs 1211 bilaterally extending from one side of the base 121 at different elevations.

The socket module 2 comprises an electrically insulative housing 21, and a set of female metal terminals 22 mounted in the electrically insulative housing 21. The electrically insulative housing 21 has a plurality of terminal slots 211. The female metal terminals 22 are respectively inserted into the terminal slots 211 and positively positioned therein. Each female metal terminal 22 comprises a base 221, a horizontally arched extension 222 extending from one side of the base 221, and two zigzagged contact prongs 2221 forwardly extending from the horizontally arched extension 222 at different elevations and different angles. The zigzagged contact prongs 2221 each terminate in a smoothly curved contact surface portion 2222. After installation, the smoothly curved contact surface portions 2222 of the horizontally arched extension 222 of the female metal terminal 22 are respectively kept in positive contact with the contact prongs 1211 of the male metal terminals 12.

Further, the base 121 of each male metal terminals 12 and the base 221 of each female metal terminals 22 respectively show a U-shaped configuration. The two contact prongs 1211 of each male metal terminals 12 are different in shape. According to this embodiment, one of the two contact prongs 1211 has a flat straight shape, and the other contact prong 1211 has a zigzagged profile. Further, the two contact prongs 1211 each have an inner bearing surface portion 1212 respectively stopped against the smoothly curved contact surface portions 2222 of the associating female metal terminal 22.

The plug module 1 further comprises a plurality of female metal terminals 122 respectively arranged in a space between two male contact terminals 12 (or at one side of the male contact terminals 12) and positioned in respective positioning holes 112 in the electrically insulative housing 11. The socket module 2 further comprises a plurality of male metal terminals 223 respectively arranged in a space between two female contact terminals 22 (or at one side of the female contact terminals 22) and positioned in respective positioning holes 212 in the electrically insulative housing 21. After installation, the male metal terminals 223 are kept in positive contact with the female metal terminals 122 respectively.

The electrically insulative housing 11 of the plug module 1 has an abutting wall 113 at the back side, and a plurality of male mounting members, for example, mounting rods 114 arranged in parallel at two opposite lateral sides of the abutting wall 113 for fastening to the electrically insulative housing 21 of the socket module 2 in the same axial direction. The electrically insulative housing 21 of the socket module 2 has an abutting wall 213 at the back side, and a plurality of female mounting members, for example, mounting holes 214 corresponding to the mounting rods 114. By plugging the mounting rods 114 into the mounting holes 214 respectively, the electrically insulative housing 11 of the plug module 1 and the electrically insulative housing 21 of the socket module 2 are fastened together, and the abutting wall 113 of the electrically insulative housing 11 is kept abutted against the abutting wall 213 of the socket module 2. Further, when plugging the mounting rods 114 into the mounting holes 214, the contact prongs 1211 of the male metal terminals 12 and the female metal terminals 122 are guided into positive contact with the contact prongs 2221 of the female metal terminals 22 and the male metal terminals 223 respectively. The engagement between the mounting rods 114 and the mounting holes 214 prohibit relative displacement between the plug module 1 and the socket module 2, avoiding contact failure or interruption between the male metal terminals 12 and the female metal terminals 22.

Figure 4:
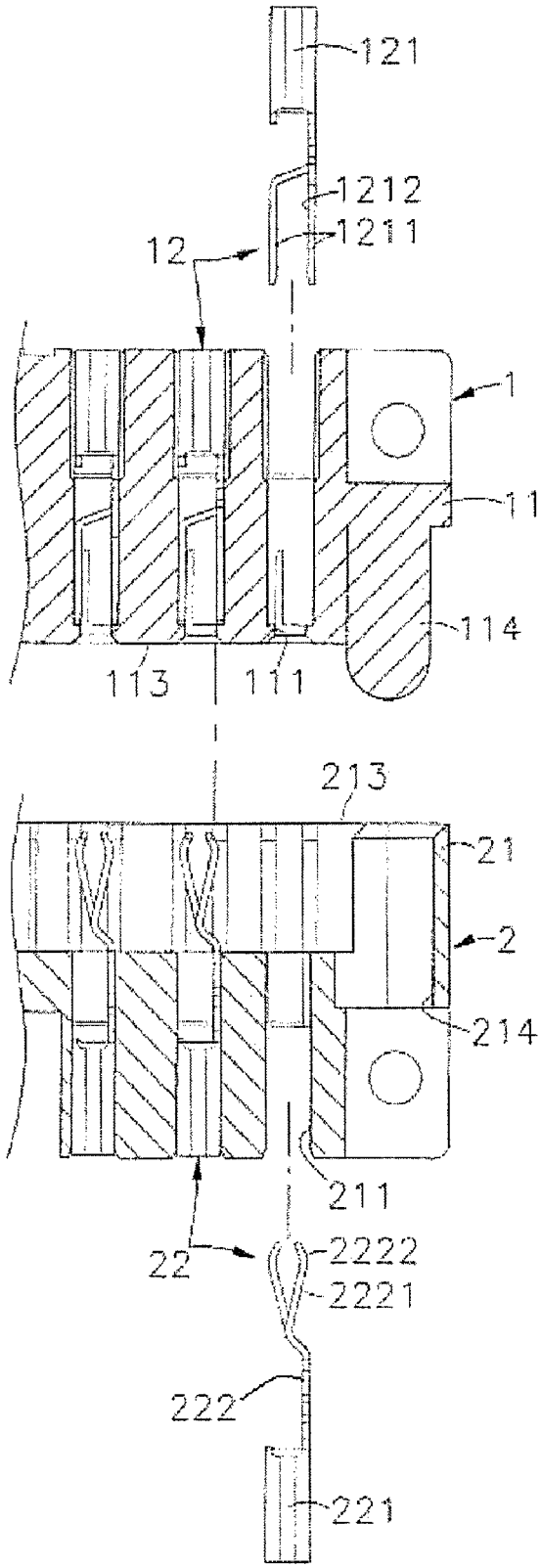
FIG. 4 is a schematic sectional exploded view of a part of the electric power connector according to the present invention.
Figure 5:
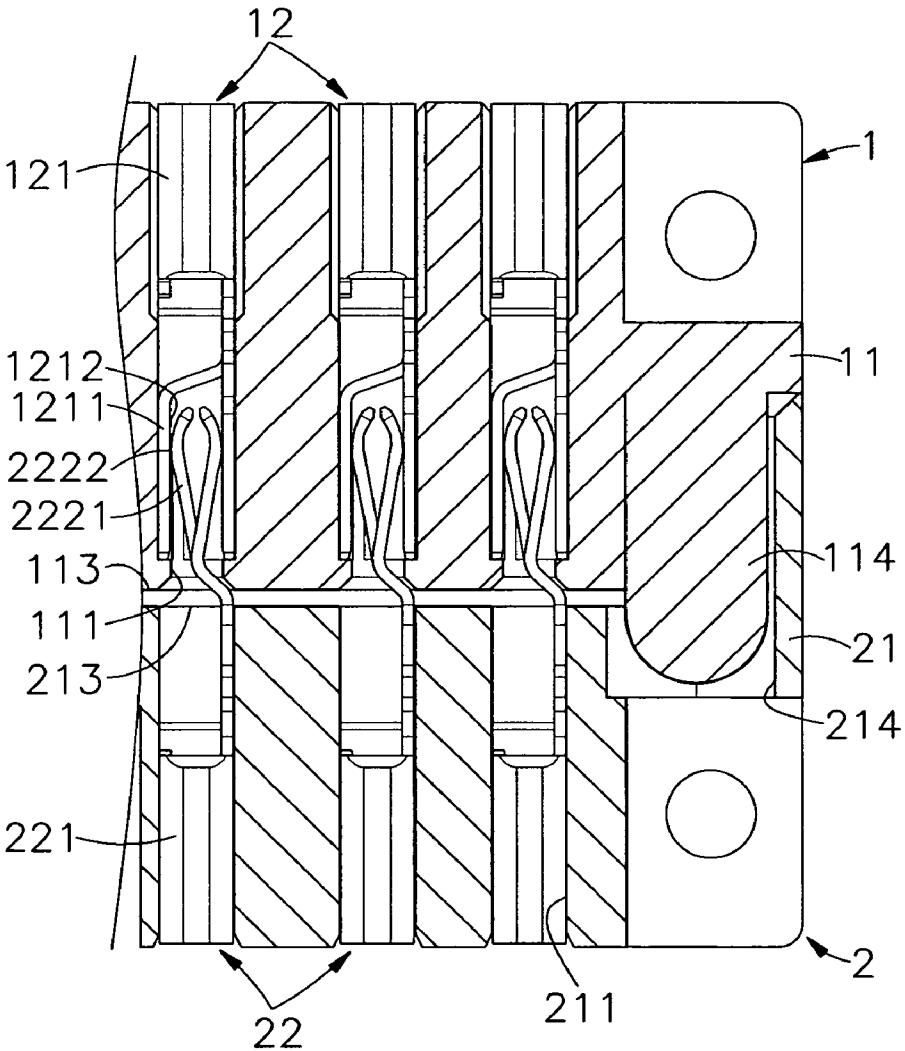
FIG. 5 is a sectional assembly view in an enlarged scale of FIG. 4.
Figure 6:
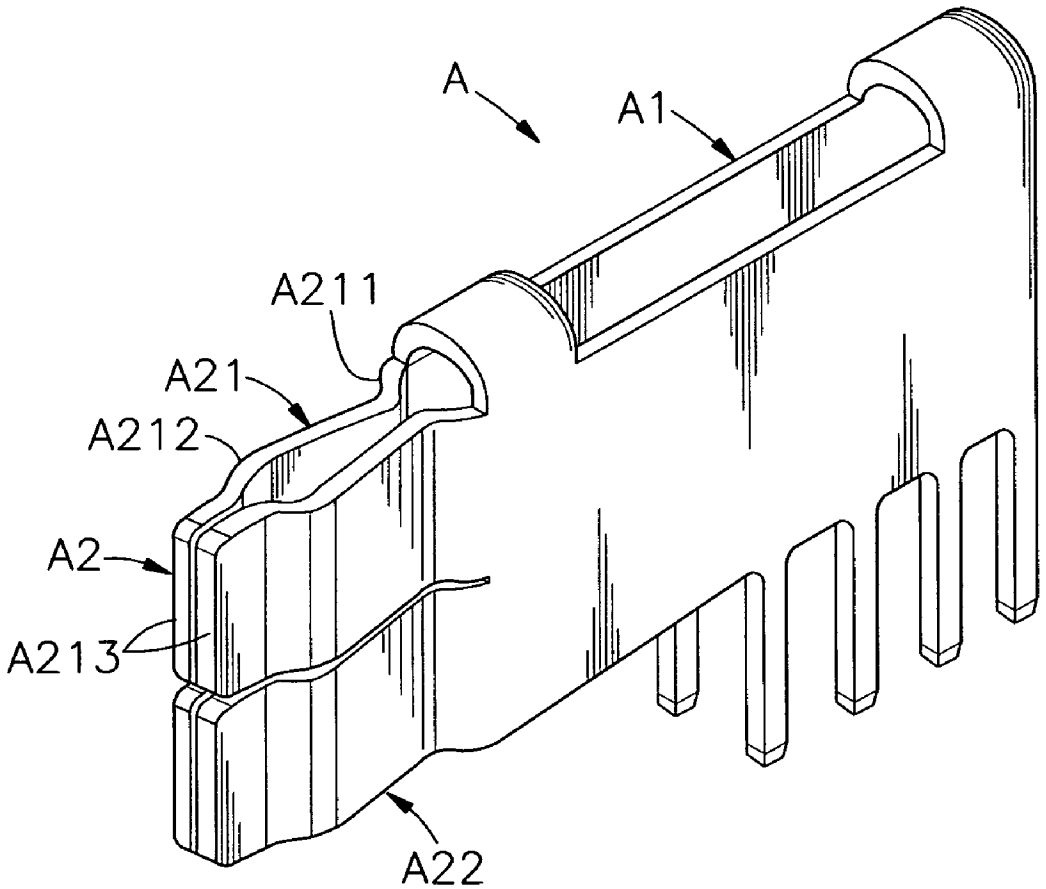
PRIOR ART FIG. 6
FIG. 6 is an elevational view of a metal terminal according to the prior art.

Referring to FIGS. 4 and 5 and FIG. 3 again, after installation of the electric power connector, the contact prongs 1211 of the male metal terminals 12 are kept in positive contact with the contact prongs 2221 of the female metal terminals 22, ensuring two-way electrical conduction. Further, when the contact prongs 1211 of the male metal terminals 12 are kept in positive contact with the contact prongs 2221 of the female metal terminals 22, the contact prongs 1211 of the male metal terminals 12 impart a pressure to the contact prongs 2221 of the female metal terminals 22, and the resilient material property of the contact prongs 2221 of the female metal terminals 22 produces a reactive force against the contact prongs 1211 of the male metal terminals 12, and therefore the smoothly curved contact surface portions 2222 of the female metal terminals 22 are maintained in positive contact with the inner bearing surface portions 1212 of the contact prongs 1211 respectively, ensuring excellent electrical connection.

The contact prongs 1211 are formed integral with the respective male metal terminals 12, and the contact prongs 2221 are formed integral with the respective female metal terminals 22, i.e., the male metal terminals 12 and the female metal terminals 22 are respectively made out of a respective solid metal plate member through a continuous stamping process. Further, the two contact prongs 1211 of each male metal terminal 12 are bilaterally extended from one side of the respective base 121 at different elevations. After current and voltage shunt, current and voltage are synthesized, and therefore, the electric power connector eliminates electron ionization or thermal stress in the metal terminals 12 and 22 after a long period transmission of high voltage and high current, i.e., long period transmission of high voltage and high current through the metal terminals 12 and 22 does not cause damage to the material structure of the metal terminals 12 and 22 to affect the electrical transmission stability and reliability of the metal terminals 12 and 22. This design also prevents elastic fatigue of the contact prongs 1211 and 2221. After long and frequent uses of the electric power connector, the contact prongs 1211 and 2221 will not deform easily. Further, because the two contact prongs 1211 of each male metal terminal 12 are bilaterally extended from one side of the respective base 121 at different elevations, when one of the two contact prongs 1211 is deformed or curved accidentally by an external force, the other contact prong 1211 is still kept in positive contact with the associating contact prong 2221 of the matching female metal terminal 22, i.e., the electrical contact stability and reliability between the male metal terminals 12 and the female metal terminals 22 are enhanced.

As stated above, the technical features of the electric power connector of the present invention that improve the prior art design are as follows:

1. The male metal terminals 12 and the female metal terminals 22 are respectively made out of a respective solid metal plate member through a continuous stamping process, and the two contact prongs 1211 of each male metal terminal 12 are bilaterally extended from one side of the respective base 121 at different elevations, therefore the electric power connector eliminates electron ionization or thermal stress in the metal terminals 12 and 22, ensuring high stability and reliability of metal terminals 12 and 22 in power transmission.

2. The contact prongs 1211 of the male metal terminals 12 do not wear easily after a long use. Because the two contact prongs 1211 of each male metal terminal 12 are bilaterally extended from one side of the respective base 121 at different elevations, when one of the two contact prongs 1211 is deformed or curved accidentally by an external force, the other contact prong 1211 is still kept in positive contact with the associating contact prong 2221 of the matching female metal terminal 22, ensuring the stability and reliability of the electrical connection between the male metal terminals 12 and the female metal terminals 22.

3. The contact prongs 1211 of the male metal terminals 12 impart a pressure to the contact prongs 2221 of the female metal terminals 22, and the resilient material property of the contact prongs 2221 of the female metal terminals 22 produces a reactive force against the contact prongs 1211 of the male metal terminals 12, and therefore the smoothly curved contact surface portions 2222 of the female metal terminals 22 are maintained in positive contact with the inner bearing surface portion 1212 of the contact prong 1211 respectively, ensuring excellent electrical connection.

4. Each male metal terminal 12 or female metal terminal 22 has the respective contact prongs 1211 or 2221 respectively extending from one side of the respective base 121 or 221. When compared with the conventional suspension arm type contact terminal design, the metal terminal design of the present invention saves much the consumption of material, thereby relatively lowering the cost.

5. The mounting rods 114 of the electrically insulative housing 11 of the plug module 1 are arranged in parallel and respectively fastened to the mounting holes 214 of the electrically insulative housing 21 of the socket module 2 in the same axial direction to guide the contact prongs 1211 of the male metal terminals 12 and the female metal terminals 122 into positive contact with the contact prongs 2221 of the female metal terminals 22 and the male metal terminals 223 respectively, avoiding contact failure or interruption between the male metal terminals 12 and the female metal terminals 22.

In general, the electric power connector of the present invention is comprised of a plug module 1 and a socket module 2. The plug module 1 has male metal terminals 12 mounted in an electrically insulative housing 11 thereof, and the socket module 2 has female metal terminals 22 mounted in an electrically insulative housing 21 thereof. Each male metal terminal 12 comprises a base 121, and two contact prongs 1211 bilaterally extending from one side of the base 121 at different elevations. Each female metal terminal 22 comprises a base 221, and two contact prongs 2221 extending from one side of the base 221 at different elevations. The plug module 1 and the socket module 2 are abutted against each other, forcing a smoothly curved contact surface portions 2222 of the female metal terminals 22 into positive contact with an inner bearing surface portions 1212 of the contact prongs 1211 of the male metal terminals 12 respectively, ensuring excellent electrical connection. Because the two contact prongs 1211 of each male metal terminal 12 are bilaterally extended from one side of the respective base 121 at different elevations, when one of the two contact prongs 1211 is deformed or curved accidentally by an external force, the other contact prong 1211 is still kept in positive contact with the associating contact prong 2221 of the matching female metal terminal 22 to ensure electrical connection between the male metal terminals 12 and the female metal terminals 22.

Although a particular embodiment of the invention has been described in detail for purposes of illustration, various modifications and enhancements may be made without departing from the spirit and scope of the invention. Accordingly, the invention is not to be limited except as by the appended claims.

The invention claimed is:

1. An electric power connector comprising:

a plug module, said plug module comprising an electrically insulative housing and a plurality of male metal terminals mounted in the electrically insulative housing of said plug module; and a socket module, said socket module comprising an electrically insulative housing abutted against the electrically insulative housing of said plug module, and a plurality of female metal terminals mounted in the electrically insulative housing of said socket module and respectively disposed in contact with said male metal terminals;

wherein:

said male metal terminals each comprise a base and two contact prongs bilaterally extending from one side of the base of the respective male metal terminal at different elevations, the contact prongs of said male metal terminals each having an inner bearing surface portion;

said female metal terminals each comprise a base, an extension extending from one side of the base of the respective female metal terminal, and two zigzagged contact prongs forwardly extending from said extension at different elevations and different angles, the contact prongs of said female metal terminals each having a smoothly curved contact surface portion, the smoothly curved contact surface portions of the contact prongs of said female metal terminals being respectively disposed in contact with the inner bearing surface portions of the contact prongs of said male meal terminals.

2. The electric power connector as claimed in claim 1, wherein the base of each of said male metal terminals and said female metal terminals has a U-shaped configuration.

3. The electric power connector as claimed in claim 1, wherein the two contact prongs of each of said male metal terminals include one flat straight contact prong and one zigzagged contact prong.

4. The electric power connector as claimed in claim 1, wherein the electrically insulative housing of said plug module comprises a plurality of mounting rods extending from an abutting side thereof; the electrically insulative housing of said socket module comprises a plurality of mounting holes formed in an abutting side thereof for receiving said mounting rods.

5. The electric power connector as claimed in claim 1, wherein said plug module further comprises a set of female metal terminals mounted in the electrically insulative housing thereof.

6. The electric power connector as claimed in claim 1, wherein said socket module further comprises a set of male metal terminals mounted in the electrically insulative housing thereof.

7. The electric power connector as claimed in claim 1, wherein the base and the two contact prongs of the male metal terminals are an integral one-piece construction.

8. An electric power connector comprising:

a plug module comprising an insulative housing and a plurality of male metal terminals mounted in the insulative housing of said plug module, each male metal terminal comprising a base and a flat straight contact prong and a zigzagged contact prong respectively extending from one side of the base and forming a receiving area between the flat straight contact prong and the zigzagged contact prong.

a socket module comprising an insulative housing abutted against the insulative housing of said plug module, and a plurality of female metal terminals mounted in the insulative housing of said socket module, each female metal terminal comprising a base, an extension extending from one side of the base, and two zigzagged contact prongs forwardly extending from said extension at different elevations and different angles and disposed in said receiving area to contact with the flat straight contact prong and the zigzagged contact prong of said male meal terminal, respectively.

* * * * *